US008622483B2

(12) United States Patent
Sollami

(10) Patent No.: US 8,622,483 B2
(45) Date of Patent: Jan. 7, 2014

(54) DUAL SLOTTED HOLDER BODY FOR REMOVAL TOOL ACCESS

(76) Inventor: Phillip Sollami, Herrin, IL (US)

( * ) Notice: Subject to any disclaimer, the term of this patent is extended or adjusted under 35 U.S.C. 154(b) by 0 days.

(21) Appl. No.: 13/352,594

(22) Filed: Jan. 18, 2012

(65) Prior Publication Data

US 2012/0181845 A1 Jul. 19, 2012

Related U.S. Application Data

(63) Continuation-in-part of application No. 12/844,988, filed on Jul. 28, 2010, now abandoned.

(51) Int. Cl.
*E21C 35/18* (2006.01)

(52) U.S. Cl.
USPC ..... 299/102; D15/140

(58) Field of Classification Search
USPC ..... D15/21, 139, 140; 299/100–111, 112 R, 299/112 T, 113
See application file for complete search history.

(56) References Cited

U.S. PATENT DOCUMENTS

| | | | | | |
|---|---|---|---|---|---|
| D271,112 | S | * | 10/1983 | Wiatt et al. | D15/140 |
| D429,262 | S | * | 8/2000 | Streich | D15/140 |
| 2002/0167216 | A1 | * | 11/2002 | Sollami | 299/106 |

* cited by examiner

*Primary Examiner* — Sunil Singh
(74) *Attorney, Agent, or Firm* — Patnaude & Videbeck

(57) ABSTRACT

A plurality of differing horizontal pairs of slot shapes are positioned in the upper body portion of a quick change type bit holder to provide access to a bit extractor tool for removing the bit holder from its associated bit block.

4 Claims, 3 Drawing Sheets

FIG. 6
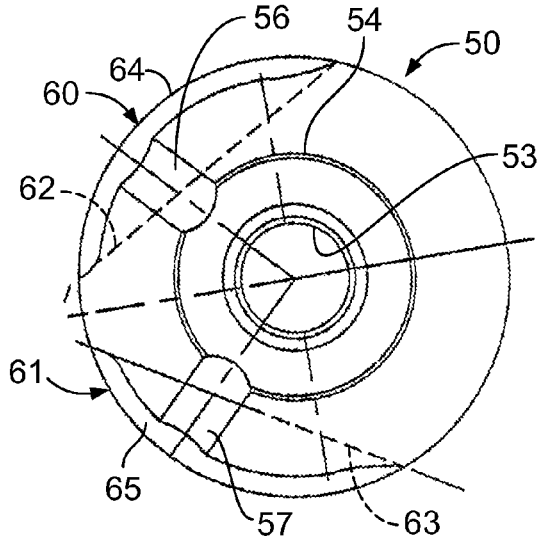
FIG. 8
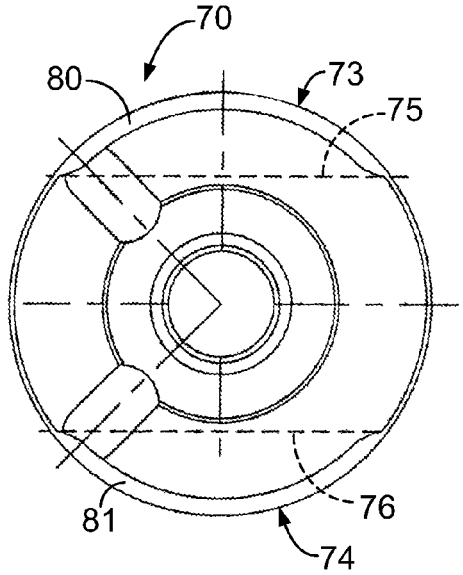
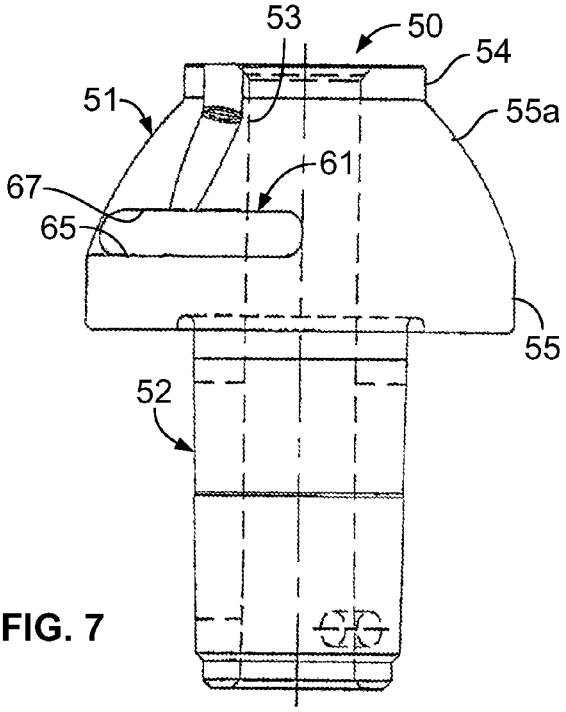
FIG. 7
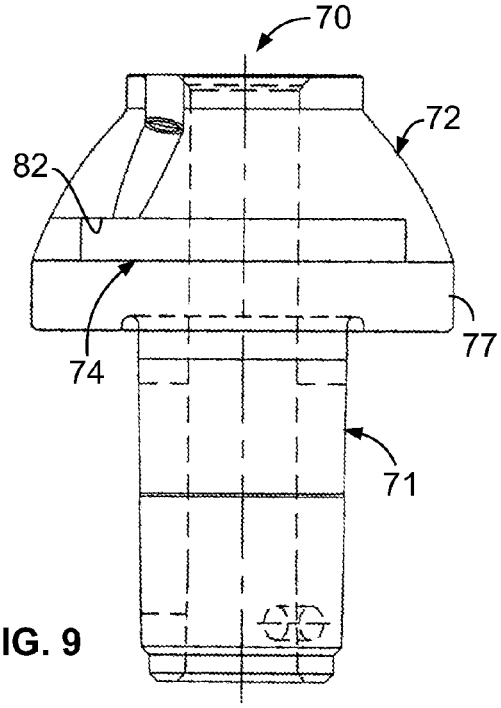
FIG. 9

DUAL SLOTTED HOLDER BODY FOR REMOVAL TOOL ACCESS

Applicant claims priority of U.S. Ser. No. 12/844,988, filed Jul. 28, 2010, the contents of which are incorporated herein by reference.

This invention relates in general to road milling, mining and trenching equipment and, more particularly, to a quick change bit holder having a new upper body configuration for accepting a removal tool therein.

BACKGROUND OF THE INVENTION

Prior to applicant's inventions U.S. Pat. Nos. 6,371,567 and 6,585,326, commercially usable bit holders as a part of bit holder assemblies, including a removable bit, a removable bit holder and a bit block mounted on a rotating drum for use mainly in road milling equipment were either mounted on bit blocks by use of a threaded nut or retaining clip, or, if not utilizing such a fastener, had a much shorter field use life than the quick change system described in those patents. Even with the continuing development of applicant's quick change bit assemblies, commercial users of the road milling, trenching and mining equipment have pressed for increased efficiency in bit holder changing operations to minimize the down time and maximize the useful operating life of road milling and other machinery utilizing these bit assemblies.

With the increased working life of the bit assemblies of applicant's prior inventions, there came a need to bulk up the structure of the bit holders to take the increased wear accompanying longer use life. Applicant's copending application Ser. No. 12/844,988 discloses an upper body portion of a bit holder which extends outwardly from the top of the bit block that retains the shank of the bit holder. This bit holder was shown in the application having an increased diameter upper body portion skirt whose bottom annular surface provided a base for a C-shape bit holder removal tool. The contents of that application are incorporated herein in total by reference.

Other assemblies and tools utilized for removal of bit holders from bit blocks are shown in applicant's prior U.S. Pat. Nos. 6,585,326; 7,883,155 and 8,069,544. Some of the prior tools utilized for removing bit holders cannot be used in instances where the bit, especially if coated with hard diamond material, is brazed onto the top of the bit holder the removal tools as described in U.S. Pat. Nos. 7,883,155 and 8,069,544 would not work in that instance. Additionally, users of applicant's equipment have indicated that bit holder removal tools that come in contact with the bit block during bit holder removal may result in degrading the outside of the bit block and would shorten longevity of the bit holder/bit block assembly useful life.

A need has developed for a bit holder upper body portion that is strong enough to have mounting slots therein capable of accepting a bit holder removal tool.

Additionally, a need has developed for a bit holder removal tool that when mounted on or adjacent a bit holder does not come in contact with the bit block.

SUMMARY OF THE INVENTION

The invention resides in a bit holder for use in road milling, mining and trenching equipment. The bit holder comprises an upper body portion, and a generally cylindrical shank extending axially from the upper body portion. The shank is of a quick-change type. The upper body portion includes a skirt having an annular bottom horizontal surface from which the generally cylindrical shank extends. The skirt is the widest diametrical part of the upper body portion. A pair of spaced apart horizontal slots are positioned on the upper body portion. The slots are in communication with an outer surface of the upper body portion and are parallel to and spatially positioned above the skirt annular bottom horizontal surface for receiving an extractor tool thereon.

BRIEF DESCRIPTION OF THE DRAWINGS

The features of the present invention which are believed to be novel are set forth with particularity in the appended claims. The invention may best be understood from the following detailed description of a currently preferred embodiment and modifications thereof taken in conjunction with the accompanying drawings wherein like numerals refer to like parts, and in which:

FIG. 6 is a top plan view of a second embodiment of the preferred invention showing opposed V-shaped slots in the upper body portion of the bit holder;

FIG. 7 is a side elevational view of the second embodiment of the preferred invention shown in FIG. 6;

FIG. 8 is a top plan view of a third embodiment of the present invention disclosing opposed spaced through horizontal slots in the upper portion of the bit holder body;

FIG. 9 is a side elevational view of the third embodiment of the present invention shown in FIG. 8;

DETAILED DESCRIPTION OF THE PREFERRED EMBODIMENTS

First Embodiment

Figure 1:
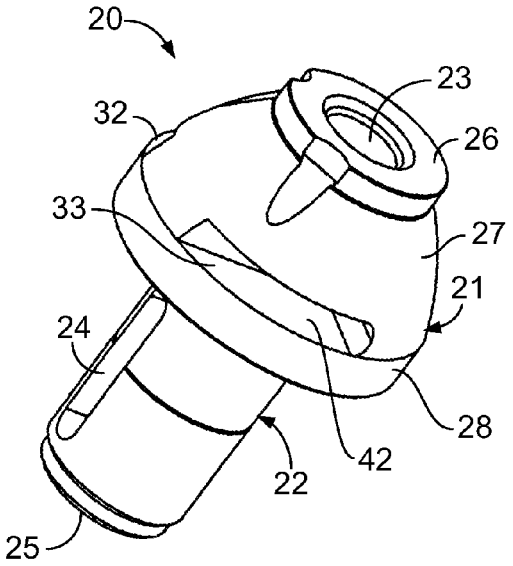
FIG. 1 is a top quarter perspective view of a first embodiment of the improved bit holder constructed in accordance with the present invention.
Figure 3:
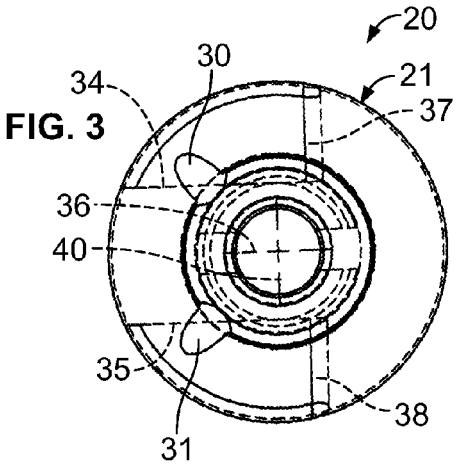
FIG. 3 is a top plan view of the bit holder shown in FIG. 1.

Referring to FIGS. 1-5, the first embodiment of the bit holder of the present invention, generally indicated at 20 is preferably made of forged steel, 4140, 8640, 4340 or the like. The bit holder includes an upper body, in this case a generally frustoconical body portion generally indicated at 21, and a lower generally cylindrical shank portion, generally indicated at 22. In this first preferred embodiment, the bit holder 20 includes a central aperture 23 through both the upper body portion 21 and the shank 22 in which a bit is preferably rotatably removably mounted during use. In use, the bit holder shank is ultra press fit into the bore of a bit holder block (101 in FIG. 10).

It will be appreciated that in some orientations, particularly when utilizing very hard materials, such as a diamond coating on the outer portion of the tip of the bit, the bit may be brazed into the aperture 23 to provide a combination bit/bit holder. In this and the other two embodiments described in more detail below, the bit holder shank 22 is generally hollow and cylindrical and includes an elongate axially oriented slot 24 which extends through one side of the side wall of the shank 22. The combination of the slot and hollow center provides the shank with a minute, but sufficient amount of diametrical play (approximately 0.005 to 0.012 for a nominal 1 inch diameter shank) to provide a super interference fit, actually a greater dimensional difference than known mechanical interference fits prior to applicant's U.S. Pat. No. 6,371,567, to allow the shank to be inserted in a bore of a bit holder and thereafter provide a sufficient outward radial force or the sides of the bit block bore to maintain the bit holder in a bit block bore even during harsh use.

In all the embodiments shown herein, the slot 24 is an internal slot in the shank 22 that does not extend outwardly to the distal end 25 of the shank. It will be appreciated that other embodiments of applicant's quick change system include slots that extend completely outward to the distal end 25 of the shank, as shown in U.S. Pat. No. 6,371,567. Either configuration will work if the dimensions are correct for the material utilized. In the present application, the invention is focused more on the upper body portion 21 of the bit holder 20.

In this first preferred embodiment, the upper body portion 21 of the bit holder 20 includes an upper annular shallow cylindrical bit mounting ring portion 26, a generally frustoconical mid-area 27 and a lower cylindrical "tire" or skirt portion 28. Outwardly adjacent the circumference of the upper short cylindrical bit mounting portion 26 are a pair of vertical notches 30, 31 that allow access to the underside of the bit tip (not shown) for easing the removal of bits from the bit holder.

As mentioned in some of my previous applications, the dimensions of bit assemblies differ depending on their intended use. Road milling machines tend to have the smallest bit assemblies with mining machines being bigger.

On prior art bit blocks heretofore known to me, the outer dimensions of the portion of the bit block on which the bit holders have been mounted, have at least been equal to or extended beyond the dimension of the adjacent tire or skirt portion of the bit holder mounted thereon.

On prior art road milling machines, bit holders had tire or skirt diameter dimensions varying from about 2 inches to 2⅝ inches, with the shank diameters of 0.765 and 0.875 inch, respectively. The tire diameter of road milling bit holders of the present invention have tire diameters of 3⅛ to 4 inches for use on the same prior art bit blocks.

Prior art mining bit holders typically had tire or skirt diameter dimensions of 2½ to 3¼ inches in diameter, with bit shank diameters of 1 and 1.1875 inches, respectively. The tire diameters of mining bit holders of the present invention which can be sleeves or part of a bit block are 2⅝ to 3½ inches, with longwall bit holders with long wall bits having step shank diameters of 1.750 to 1.375 inches being larger than continuous mining bit holders.

In one important aspect of the present invention, upwardly adjacent the bottom of the generally frustoconical mid-area 27 of the upper body are positioned a pair of opposing horizontal radial segmented slots, generally indicated at 32 and 33, respectively. While the slots 32, 33, respectively, are shown in FIGS. 1, 2 and 4, FIGS. 3 and 5 show the inner side and end surfaces of the respective slots in dotted line. Opposed inner sides 34 and 35, respectively, are parallel and spatially related across the centerline 36 of the bit holder. Each of the respective slots include an end wall 37, 38, respectively, which also are parallel and equally spatially related to the second centerline 40 shown in FIGS. 3 and 5. In this preferred embodiment used for road milling, the end walls are positioned ½ inch apart across the upper body portion, are ⅝ inch deep at their maximum extended inwardly to the centerline of the bit holder. Each slot is 5/16 inch in height.

Figure 4:
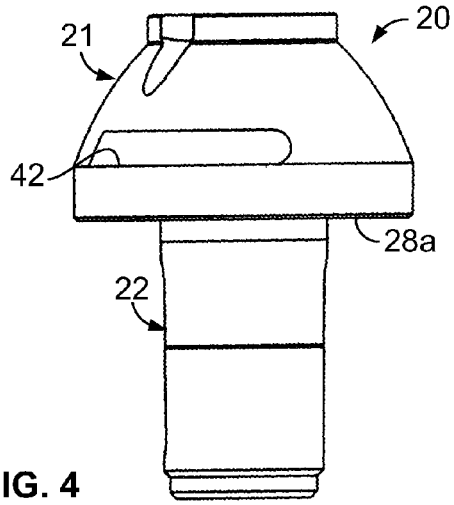
FIG. 4 is a side elevational view, 90 degrees from that shown in FIG. 2 of the bit holder of the present invention.
Figure 2:
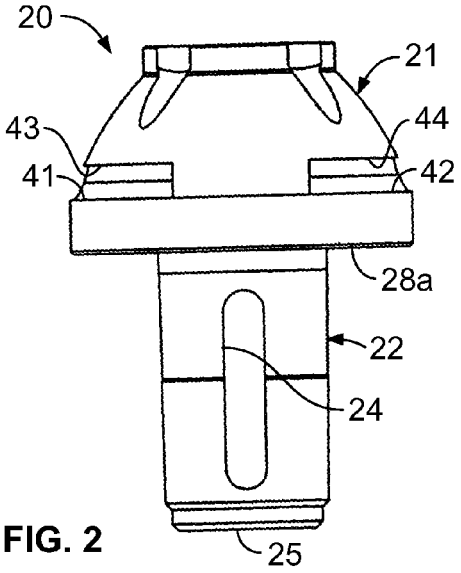
FIG. 2 is a side elevational view of the bit holder shown in FIG. 1.
Figure 5:
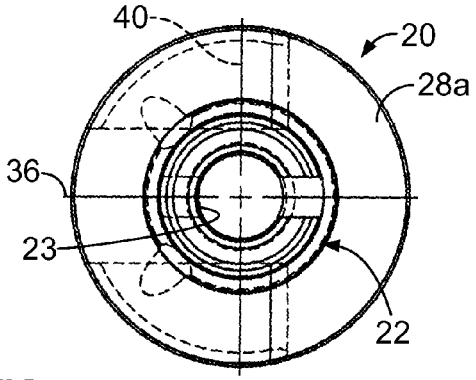
FIG. 5 is a bottom elevational view of the bit holder shown in FIGS. 1-4.

In this preferred embodiment, the bottom walls of slots 32 and 33 are found at 41, 42, respectively. They also define the top of the cylindrical tire portion 28 of the upper body 21. The opposed slot's top walls 43 and 44 are parallel and spaced above the bottom walls slightly higher than the thickness of a tool utilized to extract the bit holder from a bit block, to be discussed in more detail below. The exposed outline of the slot identified at 33 is shown in FIG. 4 and is a minor image of the outline of outline of slot 32 shown in FIGS. 1 and 2.

Figure 10:
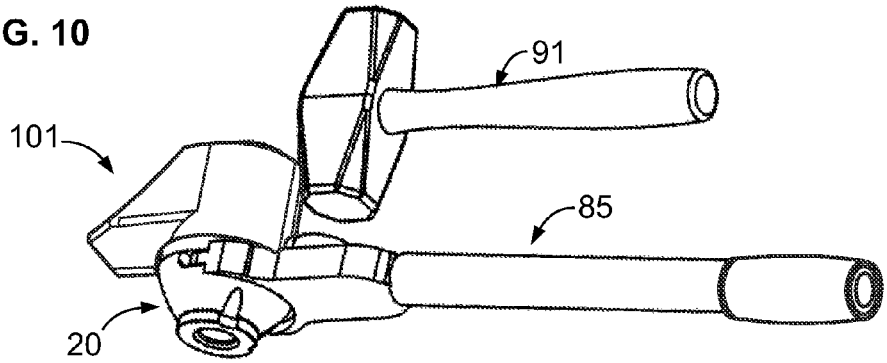
FIG. 10 is a bottom quarter perspective view of the bit holder removal tool, constructed in accordance with the present invention mounted on the first embodiment of the preferred invention, which in turn is mounted in a bit block.

It should be noted again that one of the reasons the slots 32, 33 in the first embodiment 20 of the present invention allow the insertion of a forked tool, and provide sufficient heft to allow the removal of the worn out bit holder 20 from a bit block such as 101 in FIG. 10, is the added mass and heft of the upper body portion 20 as first described in the specification of copending application Ser. No. 12/844,988. The annular bottom **28*a* of the upper body portion is about 0.5 inch in diameter greater than the outline of the bit block 101** on which it is mounted, lending added mass to that part of the bit holder.

The Second Embodiment

Referring now to FIGS. 6 and 7, a second preferred embodiment of the present invention, generally indicated at 50, like the first embodiment 20, includes a generally frustoconical upper body portion 51 and a lower, generally cylindrical shank portion 52. In this second embodiment, the shank portion 52 is identical to the shank portion 22 of the first embodiment, although it may have other configurations as shown in my prior patents noted above. Also, similarly to the first embodiment, a central axial bore 53 extends through both the upper body portion and the lower shank portion through the bit holder. Also, in this embodiment, the upper bit mounting portion 54 and the tire portion 55 are substantially identical to those respective portions of the first embodiment.

The notches 56 and 57 are similarly oriented to notches 30 and 31 of the first embodiment. However, the bottom portion of the notches differs in that they intersect the top of the opposed V-shape slots 60, 61 of the second embodiment. The slots 60, 61 of the second embodiment are opposed and mirror images of one another, and are ½ inch apart at their closest end in the road milling size. They extend at one side of the top body portion upwardly in the central frustoconical area **55*a* immediately above the tire portion 55. Slots 60 and 61 include diverging V-shape opposed back walls 62, 63, respectively, 0.573 inch at their deepest extent, opposed bottom walls 64, 65 respectively, and opposed top walls 66 (one not shown) and 67. The height of the slots are 5/16 inch in this embodiment. The external outline of the slots are shown at 60 and 61. Slots 60, 61 together define a V-shape dual opposed slot configuration with the preferred embodiment having the back walls 62-63**, 60 degrees apart, suitable for receiving a V-shape forked tool, to be discussed in more detail below.

Again, it should be noted that by positioning the opposed slots 60-61, horizontally above and adjacent to the tire portion 55, then provide a spatial relation between the slots and the bottom of the upper body portion enabling the removal tool to be positioned in spatial relation to the bit block such as shown at 101 in FIG. 10 for the first embodiment.

The Third Embodiment

Referring to FIGS. 8 and 9, a third preferred embodiment of the present invention, generally indicated at 70, is similar in most respects to the first embodiment 20 with an identical shank 71 and a similar upper body portion 72, with the exception that a pair of opposed horizontal slots are somewhat shallower than the slots 32-33 shown in FIG. 1 but each extend substantially through a frustoconical middle of the upper body portion 20 such that there is no back wall as indicated at 37 and 38 of the first embodiment. Opposed parallel slots 73-74 shown partly in dotted line in FIG. 8 and slot only 74 shown in FIG. 9, in this preferred third embodiment, are somewhat shallower toward the longitudinal axis of the bit holder than slots 32, 33 of the first embodiment 20, being 1.875 inches apart from each other in the road milling size, but they extend through the upper body portion to the opposing side thereof, and are about ⅝ inch deep at their deepest part and 5/16 inch high, as shown most clearly in FIG. 8.

The side walls 75, 76 are parallel and spaced apart. Similarly to the first and second embodiments, the bottom walls of the slots 73 and 74 define the upper boundary of the tire portion 77 and are shown at 80 and 81. The tire or skirt portion is ½ inch in_height in the road milling configuration. Likewise to the first two embodiments, the upper walls of the slots (only 82 shown) are parallel and horizontally in the same plane in spaced relation to the bottom surface of the slots, slightly larger than the thickness of the C-shaped tool utilized to remove the bit holders from their bit blocks, to be discussed in more detail below. The same C-shape tool may be utilized to remove either embodiment 1 or 3 from a respective bit block.

Removal Tools and in Operation

Figure 11:
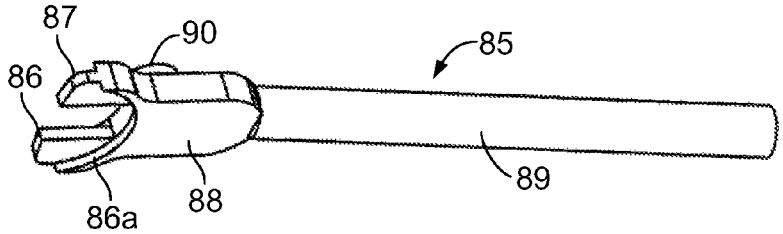
FIG. 11 is a bottom quarter perspective view of the bit holder removal tool shown in FIG. 10 as it appears by itself.

Referring to FIGS. 10 and 11, a first embodiment of an improved bit holder removal tool, generally indicated at 85 is shown to have bifurcated distal ends 86-87 joined at a bight portion 88 which in turn is connected to an elongate handle 89. The top of the bight portion also includes a short generally cylindrical striking or anvil portion 90 which is adapted to receive blows from a sledge hammer, generally indicated at 91.

The bit holder of the first embodiment, generally indicated at 20 is positioned in an upside down vertical position on its mounting drum 101. The bifurcated ends 86-87 of the extracting tool 85 are positioned in slots 32-33 and, as indicated previously, the positioning of the slots 32-33 are spatially related from the annular bottom surface 28*a* (FIGS. 2, 4 and 5) of the upper body portion to allow both the tool 85 and the hammer 91 to avoid making contact with the bit block during the extraction process. A number of strikes from the sledge hammer on the anvil 90 will remove the bit holder 20 from the bit block 101.

As shown most clearly in FIG. 11, the bifurcated tips 86-87 are parallel in their inner sides (only 86*a* shown) so as to fit in the slots 32-33. The only difference between the tool 85 and a tool utilized for use in the third embodiment shown in FIG. 8, may be additionally elongate bifurcated distal ends, although the tool 85 would also work on the third embodiment, as it is shown.

Figure 12:
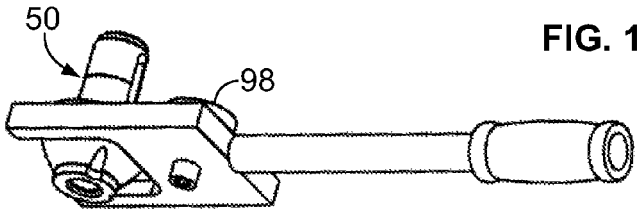
FIG. 12 is a bottom quarter perspective view of the second embodiment of the preferred invention of the bit holder shown FIGS. 6 and 7 with the bit holder removal tool utilized therefor mounted thereon.
Figure 13:
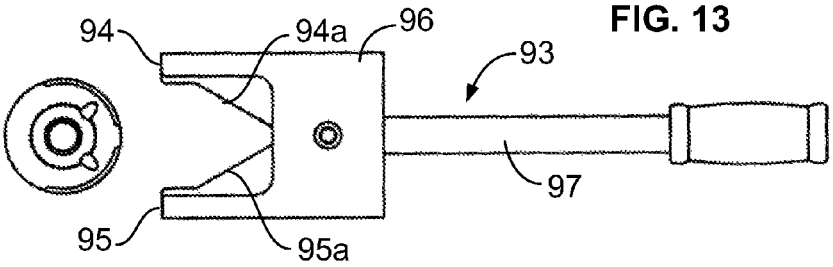
FIG. 13 is a bottom elevational view of the bit holder and bit holder removal tool shown in FIG. 12.

Referring to FIGS. 12 and 13 a second embodiment of an extractor tool, utilized in extracting the bit holder 50 of the second embodiment from a bit block (such as shown at 101) is shown, generally at 93. Extractor 93 includes a bifurcated distal end having arms 94 and 95 which meet at a bight portion 96 connected to an elongate handle 97. The inner surface of bight portions 94 and 95 include diverging V-shape inner sides 94*a* and 95*a* which diverge at the same preferred 60 degree angle as the divergence of slots 60 and 61 of the second embodiment.

Similarly to the first extractor embodiment 85, a short cylindrical anvil 98 is mounted on the top of the bight portion 96 to provide a place for the striking of a sledge hammer such as 91 in FIG. 10, when the insides 94*a*-95*a* of the distal portions 94 and 95 are positioned in the slots 60-61 of the second embodiment of the bit holder 50. As with the first extractor 85, the position of the slots 60-61 in the second embodiment 50 allow the extractor 93 to be spatially related from the bit block, such as shown in FIG. 10, when the distal ends 94 and 95 are positioned such that the inner surfaces 94*a* and 95*a* are in slots 60-61, respectively.

As with the first extractor 85, a number of blows from the sledge hammer 91 on the anvil 98 allow the extraction of the second embodiment bit holder 50 from its related bit block.

While three differing embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A bit holder for use in road milling, mining and trenching equipment, said bit holder comprising:

an upper body portion and, a generally cylindrical shank extending axially from said upper body portion, said shank being of a quick-change type, said upper body portion including a skirt having an annular bottom horizontal surface from which said generally cylindrical shank extends, and skirt being the widest diametrical part of said upper body portion, a pair of spaced apart horizontal slots on said upper body portion, said slots being in communication with an outer surface of said upper body portion and being parallel to and spatially positioned above said skirt annular bottom horizontal surface for receiving an extractor tool thereon, each of said pair of spaced apart horizontal slots are further defined by at least one vertical inner sidewall, and parallel spaced apart top and bottom surfaces extending radially outwardly from top and bottom edges of each said vertical inner side walls, respectively and in communication with said outer surface of said upper body portion.

2. The bit holder as defined in claim 1 wherein the bottom surface of each of said spaced apart horizontal slots is positioned adjacent a top of said skirt portion of said upper body portion.

3. The bit holder as defined in claim 1 wherein:

a periphery of said annular bottom horizontal surface of said skirt extends radially beyond the boundaries of a bit block on which it is mounted to provide added mass and strengthen said upper body portion.

4. A bit holder for use in road milling, mining and trenching equipment, said bit holder comprising:

an upper body portion and, a generally cylindrical shank extending axially from said upper body portion, said shank being of a quick-change type, said upper body portion including a skirt having an annular bottom horizontal surface from which said generally cylindrical shank extends, and skirt being the widest diametrical part of said upper body portion, a pair of spaced apart horizontal slots on said upper body portion, said slots being in communication with an outer surface of said upper body portion and being parallel to and spatially positioned above said skirt annular bottom horizontal surface for receiving an extractor tool thereon, each of said pair of spaced apart horizontal slots includes an inner vertical wall, said respective inner walls being parallel, each said vertical inner wall includes two parts that intersect at right angles and at their opposing ends and are in communication with said outer surface of said upper body portion.

* * * * *